US010136681B1

(12) United States Patent
Malik

(10) Patent No.: US 10,136,681 B1
(45) **Date of Patent: *Nov. 27, 2018**

(54) DUAL USE BRA GARMENT FOR USER-SELECTED CONVERSION BETWEEN A CONVENTIONAL NURSING BRA CONFIGURATION AND A BREAST MILK ENGORGEMENT INHIBITING CONFIGURATION

(71) Applicant: Rabia Malik, Fort Lauderdale, FL (US)

(72) Inventor: Rabia Malik, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/698,730

(22) Filed: Sep. 8, 2017

Related U.S. Application Data

(63) Continuation-in-part of application No. 14/675,982, filed on Apr. 1, 2015, now Pat. No. 9,756,880.

(51) Int. Cl.

| | |
|---|---|
| ***A41C 3/04*** | (2006.01) |
| ***A41C 3/00*** | (2006.01) |
| ***A41C 3/12*** | (2006.01) |
| *A41F 15/02* | (2006.01) |

(52) U.S. Cl.
CPC ..... *A41C 3/0035* (2013.01); *A41C 3/04* (2013.01); *A41C 3/12* (2013.01); *A41F 15/02* (2013.01)

(58) Field of Classification Search
CPC .... A41C 3/00; A41C 3/04; A41C 3/12; A41C 3/0035; A41C 3/14; A41C 3/148; A41C 3/005; A41C 3/0057; A41C 3/0064; A41C 1/10; A41C 1/12; A41C 3/02; A41D 13/1236; A41D 13/1245; A41D 2400/38
USPC ..... 450/86, 88, 89, 36, 54–58
See application file for complete search history.

(56) References Cited

U.S. PATENT DOCUMENTS

| | | | | |
|---|---|---|---|---|
| 1,448,639 A * | 3/1923 | Reece | A41C 3/00 | 450/59 |
| 2,284,382 A * | 5/1942 | Elberfeld | A41C 3/00 | 450/62 |
| 2,607,038 A * | 8/1952 | Spare | A41C 3/0021 | 450/59 |
| 2,650,363 A * | 9/1953 | Lo Cascio | A41C 3/0021 | 2/325 |
| 4,325,378 A * | 4/1982 | Wilkinson | A41C 3/02 | 450/58 |

(Continued)

*Primary Examiner* — Gloria Hale
(74) *Attorney, Agent, or Firm* — Glenn E. Gold; Glenn E. Gold, P.A.

(57) ABSTRACT

A dual function, convertible bra garment includes a construction facilitating user-controllable conversion between a nursing bra configuration, readily usable during a conventional infant or young toddler nursing process, and a breast engorgement-inhibiting configuration. During use as a nursing bra, the garment is maintained in a first configuration, or state, providing direct access by a nursing child to a mother's nipple. Following a relatively simple highly-controllable conversion procedure, the nursing configuration is efficiently and effectively converted, generally based upon a combined elastic band strap-based system, for applying a user-selected uniform breast pressure, coupled with a user—controlled cooling component, and absorbing component, for indirectly communicating cooling to the wearer's breasts or discharge absorption pad, thereby effecting complete conversion of the bra from a nursing configuration to a breast milk engorgement inhibiting configuration.

20 Claims, 14 Drawing Sheets

(56) References Cited

U.S. PATENT DOCUMENTS 4,444,191 A * 4/1984 Harned ..... A41C 3/0057 2/45
4,781,651 A * 11/1988 Ekins ..... A41C 3/0057 450/25
5,098,331 A * 3/1992 Corrado ..... A41C 3/0064 128/100.1
5,427,563 A * 6/1995 Manning ..... A61F 7/02 2/73
5,863,236 A * 1/1999 Johnson ..... A41C 3/0057 450/60
5,968,003 A * 10/1999 Sisson ..... A41C 3/0064 602/19
6,135,975 A * 10/2000 Johnstone ..... A41C 3/0064 602/19
6,755,717 B2 * 6/2004 Smith ..... A41C 3/0057 128/869
7,909,675 B1 * 3/2011 Rainey ..... A41C 3/148 450/59
8,317,569 B2 * 11/2012 Fisher-Pacheco ..... A41F 1/006 450/58
8,858,295 B2 * 10/2014 Thompson ..... A41F 15/002 450/10
8,900,032 B2 * 12/2014 Punsal ..... A41C 3/122 450/17
9,192,197 B2 * 11/2015 Reinhard ..... A41C 3/02
9,756,880 B1 * 9/2017 Malik ..... A41C 3/12
2009/0259159 A1 * 10/2009 Bell ..... A41C 3/0064 602/75
2012/0028541 A1 * 2/2012 Donnelly ..... A41C 3/0021 450/86
2013/0167284 A1 * 7/2013 Conner ..... A41D 1/00 2/69
2013/0316616 A1 * 11/2013 Thompson ..... A41F 15/002 450/66
2015/0099420 A1 * 4/2015 Reinhard ..... A41C 3/0064 450/58

* cited by examiner

DUAL USE BRA GARMENT FOR USER-SELECTED CONVERSION BETWEEN A CONVENTIONAL NURSING BRA CONFIGURATION AND A BREAST MILK ENGORGEMENT INHIBITING CONFIGURATION

CROSS REFERENCE TO RELATED APPLICATION(S)

This U.S. non-provisional patent application is a continuation-in-part of, and claims priority to, U.S. Non-Provisional patent application Ser. No. 14/675,982, filed on Apr. 1, 2015, and issuing on Sep. 12, 2017 (as U.S. Pat. No. 9,756,880), the entire contents of which are incorporated-by-reference herein.

FIELD OF THE INVENTION

The present invention relates generally to techniques for suppressing breast milk production and, more particularly, is concerned with a convertible bra garment serving the dual purposes of nursing and inhibiting engorgement of breasts with breast milk.

BACKGROUND OF THE INVENTION

A woman's breasts begin to develop and produce milk during the middle of her pregnancy; sometimes as early as 16 to 18 weeks into the pregnancy. The production of breast milk, commonly referred to as lactation, makes the breasts swell and feel engorged. The body will initiate this process early and it will continue to occur even in the case where a pregnancy ends unsuccessfully and, therefore, lactation is no longer needed or desired. The placenta makes hormones to stop milk production. When the placenta is gone, the hormone levels drop and the breasts start making milk.

Normally, suckling at the breast nipples provide signals to the breasts to let down milk already produced, and to continue to produce more milk. Absent suckling, there is no such demand and eventually the breasts will stop making more supply. However, if the milk already produced is not removed from the breasts, this can become very painful because of tightness and soreness associated with fully engorged breasts.

Unfortunately, it is not uncommon for a miscarriage to occur during the first or second trimester of a woman's pregnancy. In some instances when a miscarriage occurs, the woman's predisposition to produce milk is lost. However, without taking steps to attempt to limit, or altogether prevent, milk production a condition commonly referred to as breast engorgement often occurs. In order to cease the production of new milk supply, it is crucial to prevent the very factors that tend to encourage milk production, commonly referred to as the "let-down" reflex or "lactation after loss." Application of pressure and support for the engorged breasts, and cooling to reduce breast swelling, are key to reducing the let-down reflex. Therefore, women who suffer from lactation after loss typically use a firm and snug bra that prevents the nipples from being stimulated, thereby reducing the lactation process. The constant diffuse pressure of a supportive bra will enable the beginning of signaling pathways in the breasts to inhibit milk production.

Therefore, there is a long felt, but as of yet unmet, need for a more effective, easy-to-employ method for selectively inhibiting the let-down reflex. in particular, it would be highly desirable to provide a single bra garment that can be easily converted to selectively function as both a nursing bra and, where desired, a breast engorgement-inhibiting bra.

SUMMARY OF THE INVENTION

The present invention overcomes the deficiencies of past approaches and the problems that remain unsolved by providing a dual use bra garment for nursing and inhibiting breast engorgement. The bra garment includes a bra that can be employed for use in nursing, and for use after nursing has ended to enable converting the bra for use in inhibiting breast engorgement by providing the desired breast support, cooling effect and diffuse pressure in a manner that will discourage milk production.

In one aspect of the present invention, a multi-configurational bra garment includes:

- a bra body portion including a left and right front face, a central gap defined by separation of said left and right front face, a rear face and a pair of right and left lateral sides adjoining said left and right front and rear face, and a pair of left and right breast cup portions integrated into the respective one of said left and right front face of said bra body,
  - wherein said pair of left and right breast cup portions include a first layer disposed over a second layer, said first layer having a first mechanical coupling mechanism attached to an upper edge, and said second layer having a second mechanical coupling mechanism attached to an upper edge, each of said first and second mechanical coupling mechanisms being configurable for releasable attachment;
- a pair of shoulder straps, each shoulder strap having a length extending, and attached at opposite shoulder strap length ends to, an upper portion of said back face of said bra body and to the respective one of each of said left and right breast cup portions second layer mechanical coupling mechanism;
- a first pair of pressure-applying straps, said first pair of straps include,
  - a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps are configured for releasable attachment when said bra garment is donned by disposing said first strap over said second strap and attaching said coupling mechanism of each respective one of said straps to a connector mechanism integrated therewith on said back face of said bra body; and
- second pair of pressure-applying straps, said second pair of straps include,
  - a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and right lateral sides of said bra body, proximate said distal end of each respective one of said second pair of pressure-applying straps being integrated therewith a coupling mechanism on said interior surface, wherein said first and second strap of said second pair of pressure-applying straps are configured for releasable attachment when said bra garment is donned by extending said first and second strap rearwardly and attaching said coupling mechanism of each respective one of said straps to said connector mechanism integrated therewith on said back face of said bra body.

In another aspect of the present invention, the corresponding first and second layer of said pair of left and right breast cup portions are partially affixed to one another defining and forming at least one interior pocket therebetween the first and second layer In yet another aspect of the present invention, the second layer of said corresponding pair of left and right breast cup portions provide a centralized circular opening enabling partial breast exposure of a wearer.

In yet another aspect of the present invention, the at least one interior pocket defined and formed by said first and second layer of said corresponding first and second breast cup portions is shaped and otherwise configured for snugly receiving a soaking pad to be retained therein and in close proximity to said circular opening provided on said second layer of said breast cup portions for absorbing fluids released from said wearer's partially exposed breast.

In still another aspect of the present invention, the centralized circular opening provided in said at least one interior pocket defined and formed by said first and second layer of said corresponding first and second breast cup portion is shaped and otherwise configured for enabling said wearer to nurse a baby.

In still another aspect of the present invention, the first and second strap of said first pair of pressure-applying straps include a gripping mechanism affixed approximately to said distal end of each respective one of said first and second straps exterior surface, enabling a wearer to grip and apply a desirable degree of pressure against a wearer's lower breast portion when said first and second strap of said first pair of pressure-applying straps are releasably attached to said connector mechanism of said back face of said bra body when said bra garment is donned.

In yet another aspect of the present invention, the first and second strap of said second pair of pressure-applying straps include a gripping mechanism affixed approximately to said distal end of each respective one of said first and second straps exterior surface, enabling a wearer to grip and apply a desirable degree of pressure against a wearer's upper breast portion when said first and second strap of said second pair of pressure-applying straps are releasably-attached to said connector mechanism of said back face of said bra garment when said bra garment is donned.

In yet another aspect of the present invention, the connector mechanism of said back face comprises of a plurality of longitudinal segments spaced-apart extending therebetween said left and right lateral sides on said back face.

In still another aspect of the present invention, a multi-configurational bra garment comprising:

a bra body portion including a left and right front face, a central gap defined by separation of said left and right front face, a rear face and a pair of right and left lateral sides adjoining said left and right front and rear face, and a pair of left and right breast cup portions integrated into the respective one of said left and right front face of said bra body, wherein said pair of left and right breast cup portions include a first layer disposed over a second layer having a centralized circular opening enabling partial exposure of a wearer's breast, said first and second layer partially affixed to one another defining and forming at least one interior pocket therebetween said first and second layer, said first layer having a first mechanical coupling mechanism attached to an upper edge, and said second layer having a second mechanical coupling mechanism attached to an upper edge, and each of said first and second mechanical coupling mechanisms being configurable for releasable attachment;

a pair of shoulder straps, each shoulder strap having a length extending, and attached at opposite shoulder strap length ends to, an upper portion of said back face of said bra body and to the respective one of each of said left and right breast cup portions second layer mechanical coupling mechanism;

a first pair of pressure-applying straps, said first pair of straps include, a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps are configured for releasable attachment when said bra garment is donned by disposing said first strap over said second strap and attaching said coupling mechanism of each respective one of said straps to a connector mechanism integrated therewith on said back face of said bra body; and a second pair of pressure-applying straps, said second pair of straps include, a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and tight lateral sides of said bra body, proximate said distal end of each respective one of said second pair of pressure-applying straps being integrated therewith a coupling mechanism on said interior surface, wherein said first and second strap of said second pair of pressure-applying straps are configured for releasable attachment when said bra garment is donned by extending said first and second strap rearwardly and attaching said coupling mechanism of each respective one of said straps to said connector mechanism integrated therewith on said back face of said bra body.

In still another aspect of the present invention, a multi-configurational bra garment comprising:

a bra body portion including a left and right front face, a central gap defined by separation of said left and right front face, a rear face and a pair of right and left lateral sides adjoining said left and right front and rear face, and a pair of left and right breast cup portions integrated into the respective one of said left and right front face of said bra body, wherein said pair of left and right breast cup portions include a first layer disposed over a second layer having a centralized circular opening enabling partial exposure of a wearer's breast, said first and second layer partially affixed to one another defining and forming at least one interior pocket therebetween said first and second layer, said first layer having a first mechanical coupling mechanism attached to an upper edge, and said second layer having a second mechanical coupling mechanism attached to an upper edge, and each of said first and second mechanical coupling mechanisms being configurable for releasable attachment;

a pair of shoulder straps, each shoulder strap having a length extending, and attached at opposite shoulder strap length ends to, an upper portion of said back face of said bra body and to the respective one of each of said left and right breast cup portions second layer mechanical coupling mechanism;

a first pair of pressure-applying straps, including:

a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps include a gripping mechanism affixed approximately to said distal end of each respective one of said first and second straps exterior surface, enabling said wearer to grip said gripping mechanism and apply a desirable degree of pressure against a wearer's lower breast portion when said bra garment is donned by disposing said first strap over said second strap and releasably-attaching said coupling mechanism of each respective one of said straps to a connector mechanism integrated therewith on said back face of said bra body; and a second pair of pressure-applying straps, including:

a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and right lateral sides of said bra body, proximate said distal end of each respective one of said second pair of pressure-applying straps being integrated therewith a coupling mechanism on said interior surface, said first and second strap of said second pair of pressure-applying straps include a gripping mechanism affixed approximately to said distal end of each respective one of said first and second straps exterior surface, enabling said wearer to grip said gripping mechanism and apply a desirable degree of pressure against a wearer's upper breast portion when said bra garment is donned by extending said first and second strap rearwardly and attaching said coupling mechanism of each respective one of said straps to said connector mechanism integrated therewith on said back face of said bra body.

In yet another aspect of the present invention, the connector mechanism of said back face comprises of a plurality of longitudinal segments spaced-apart extending therebetween said left and right lateral sides on said back face.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Figure 2:
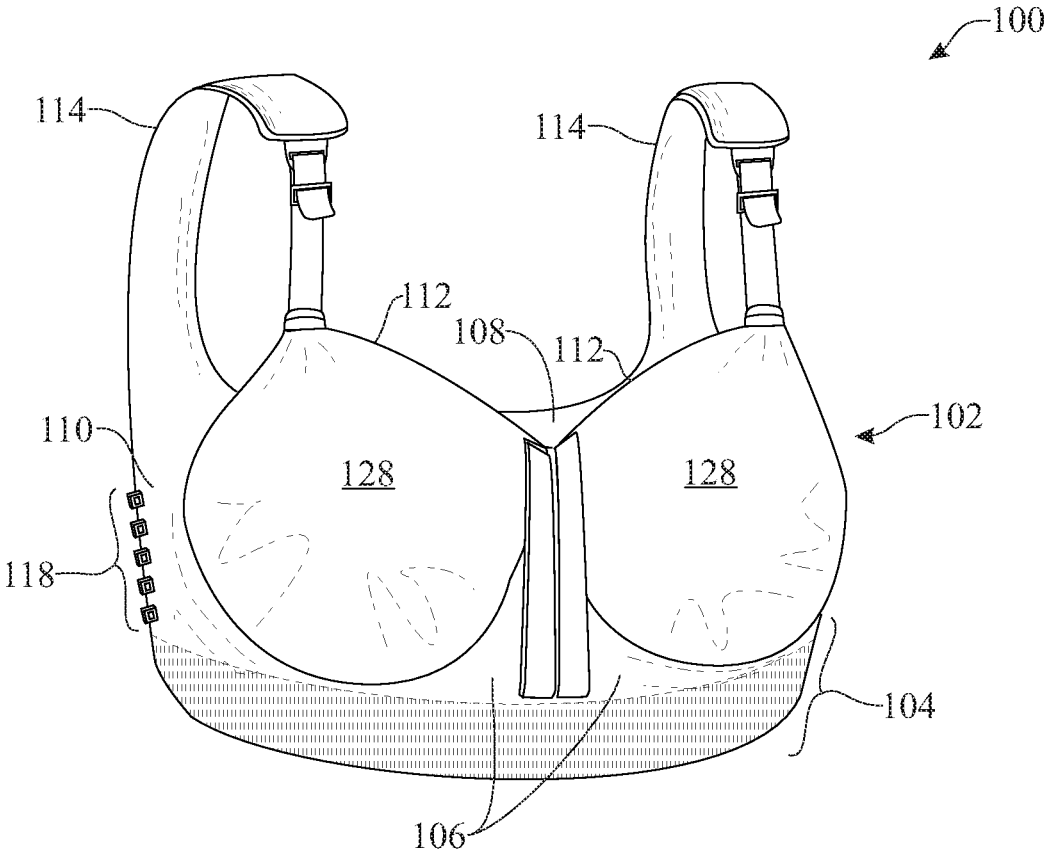
FIG. 2 presents a front isometric view of the bra garment as originally introduced in FIG. 1.
Figure 3:
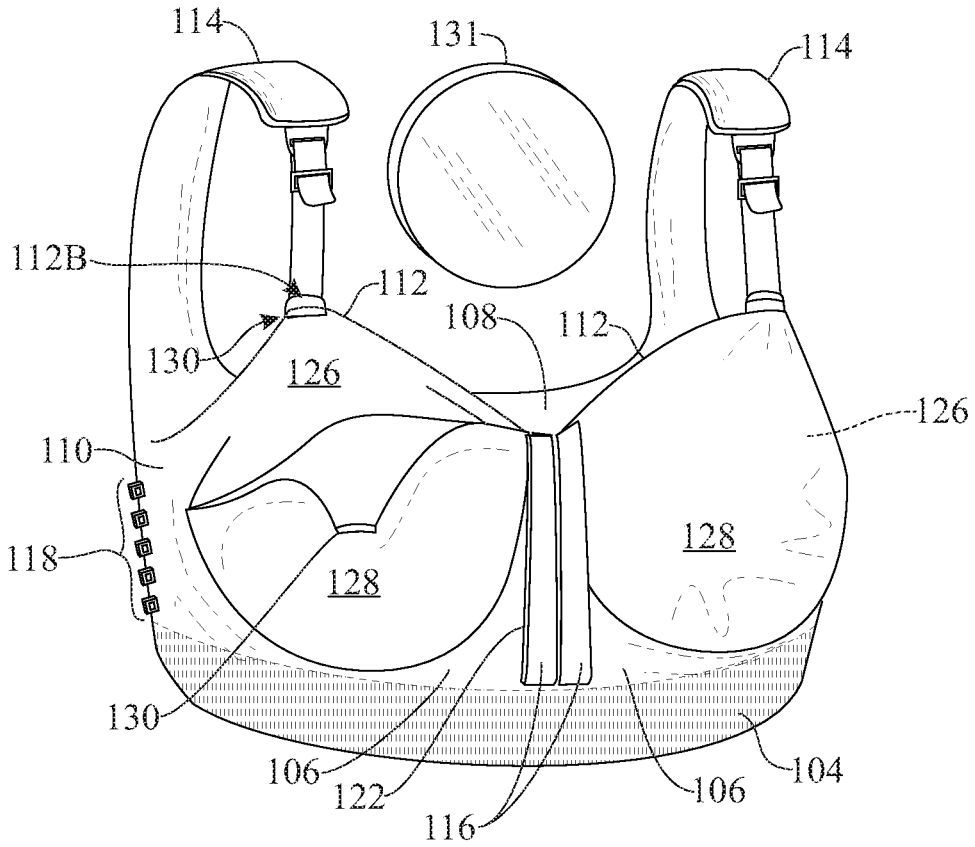
FIG. 3 presents a front isometric view of the bra garment of FIG. 2, now showing some attachments on the bra garment in the form of left and right flaps, which form left and right pockets, with one of the pockets being shown at least partially opened to selectively receive a temperature-reducing object.
Figure 4:
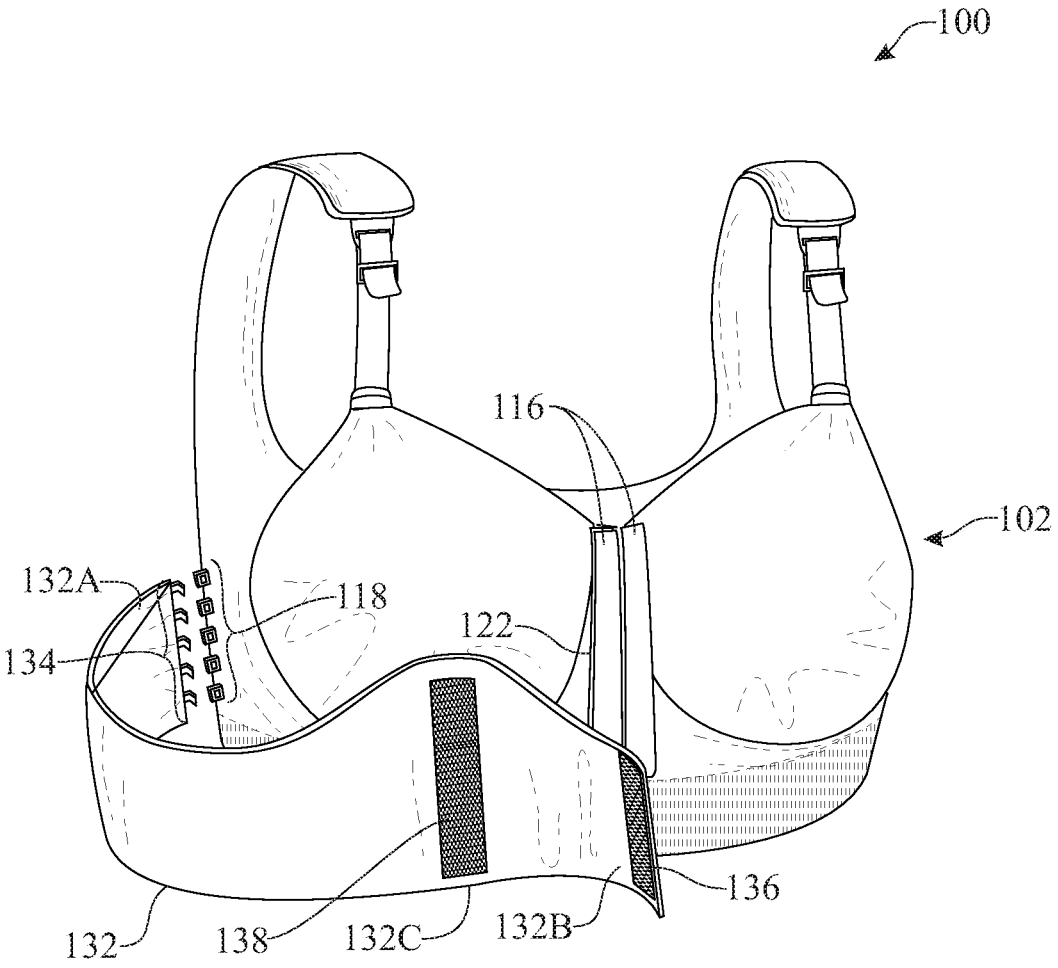
FIG. 4 presents a front isometric view of the bra garment of FIG. 2, now showing other attachments on the bra garment in the form of one band being detached from the bra garment.
Figure 10:
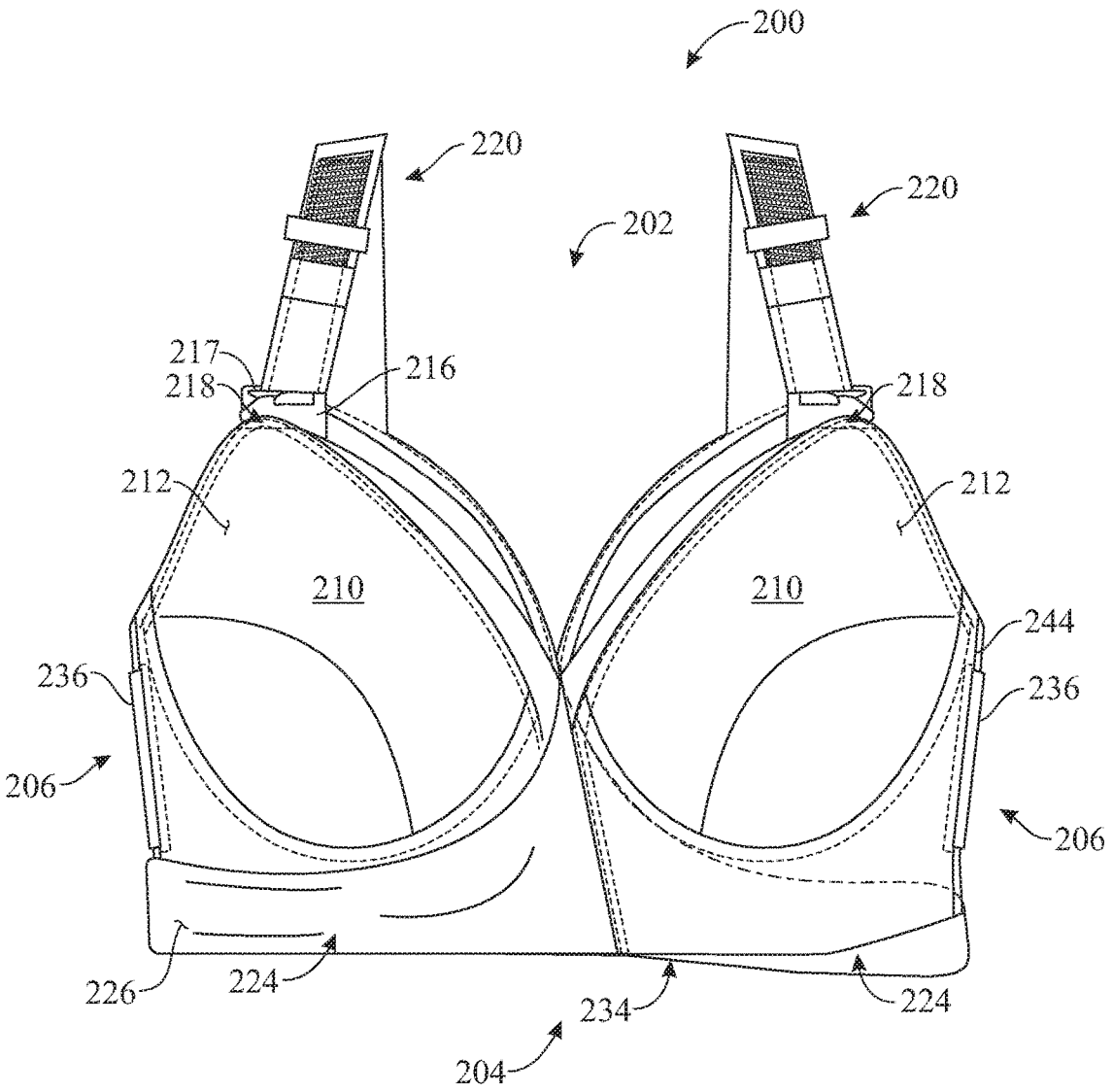
Figure 11:
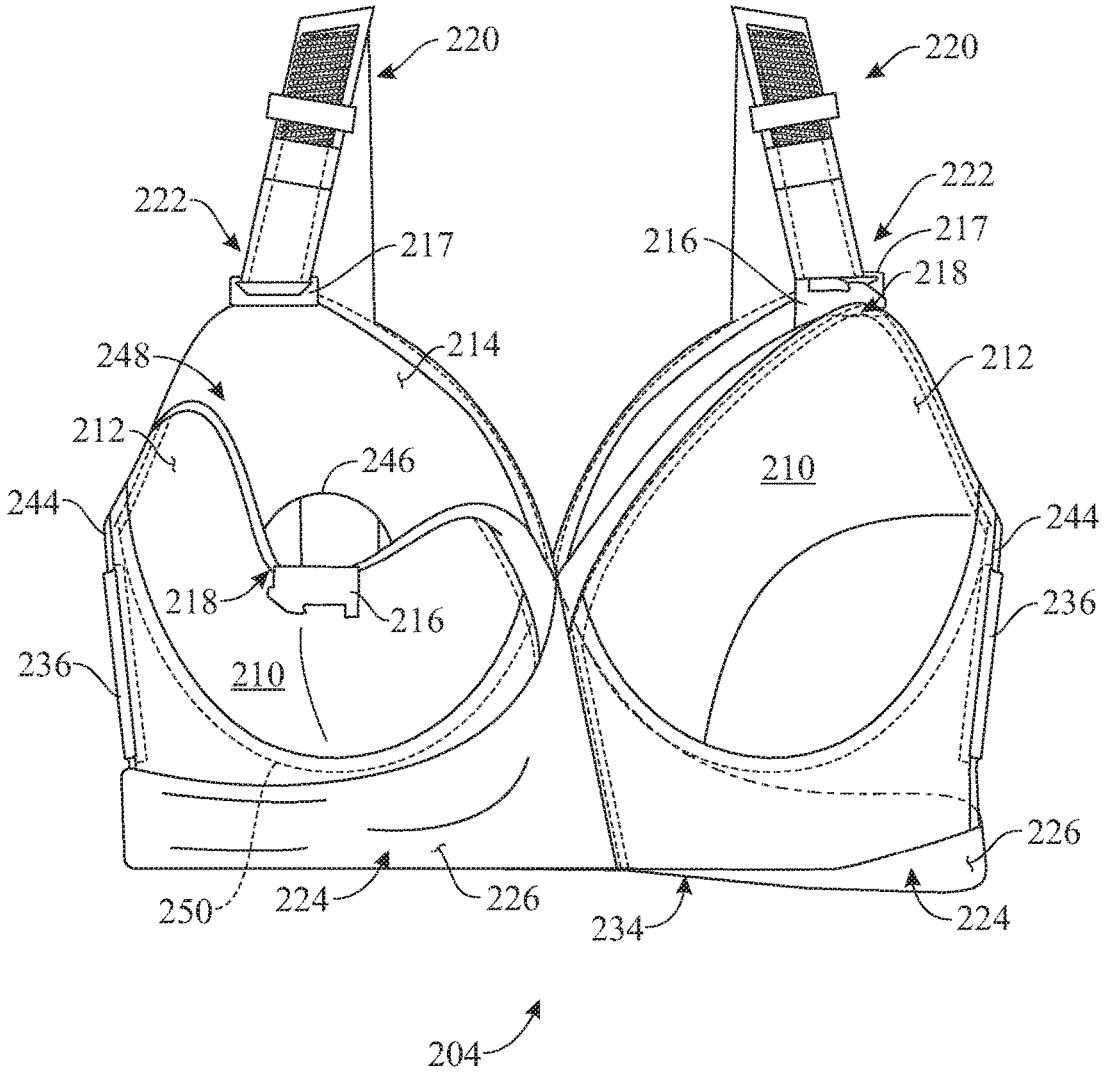
Figure 12:
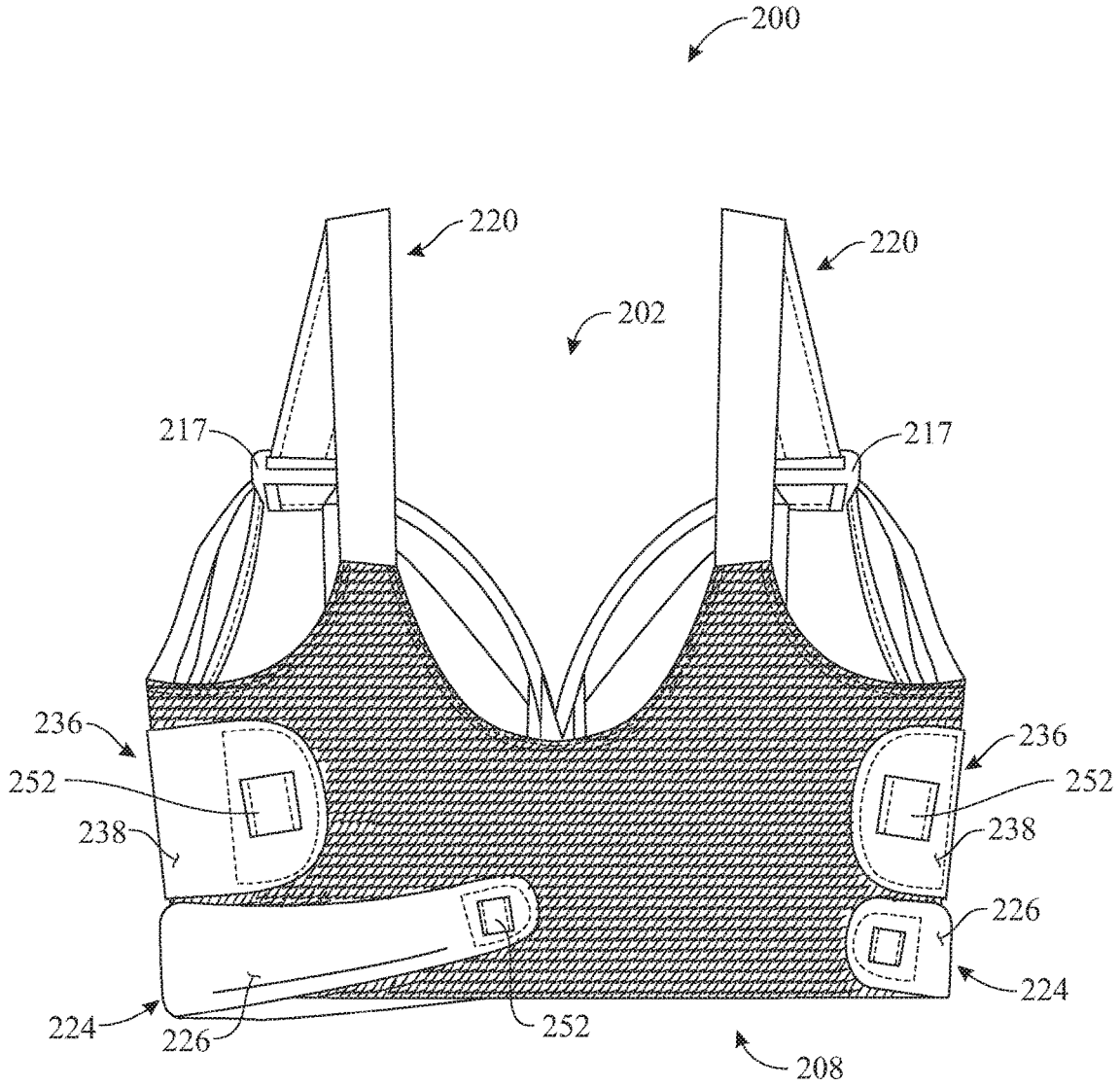
Figure 13:
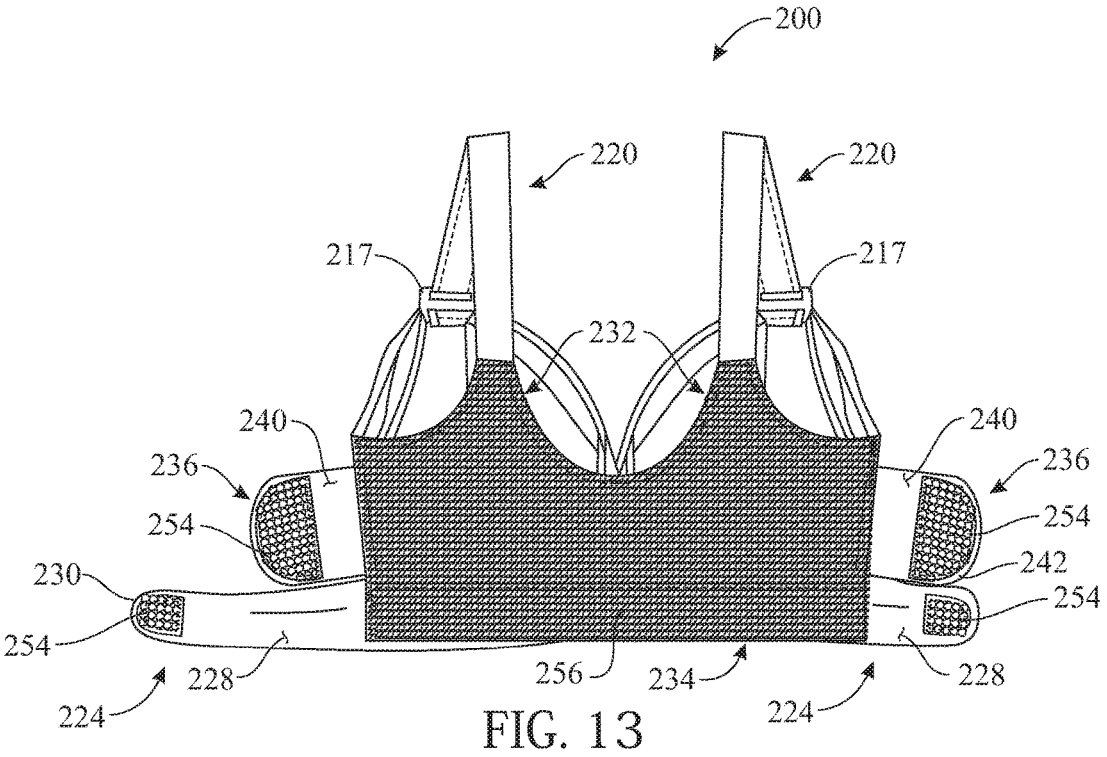
Figure 14:
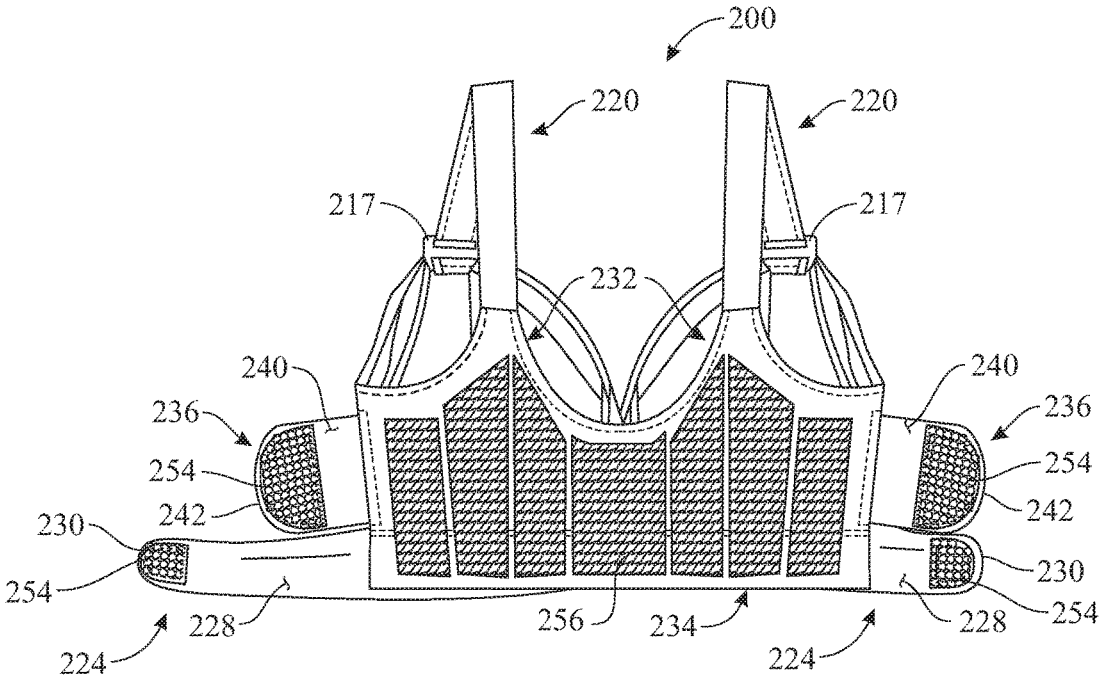
Figure 15:
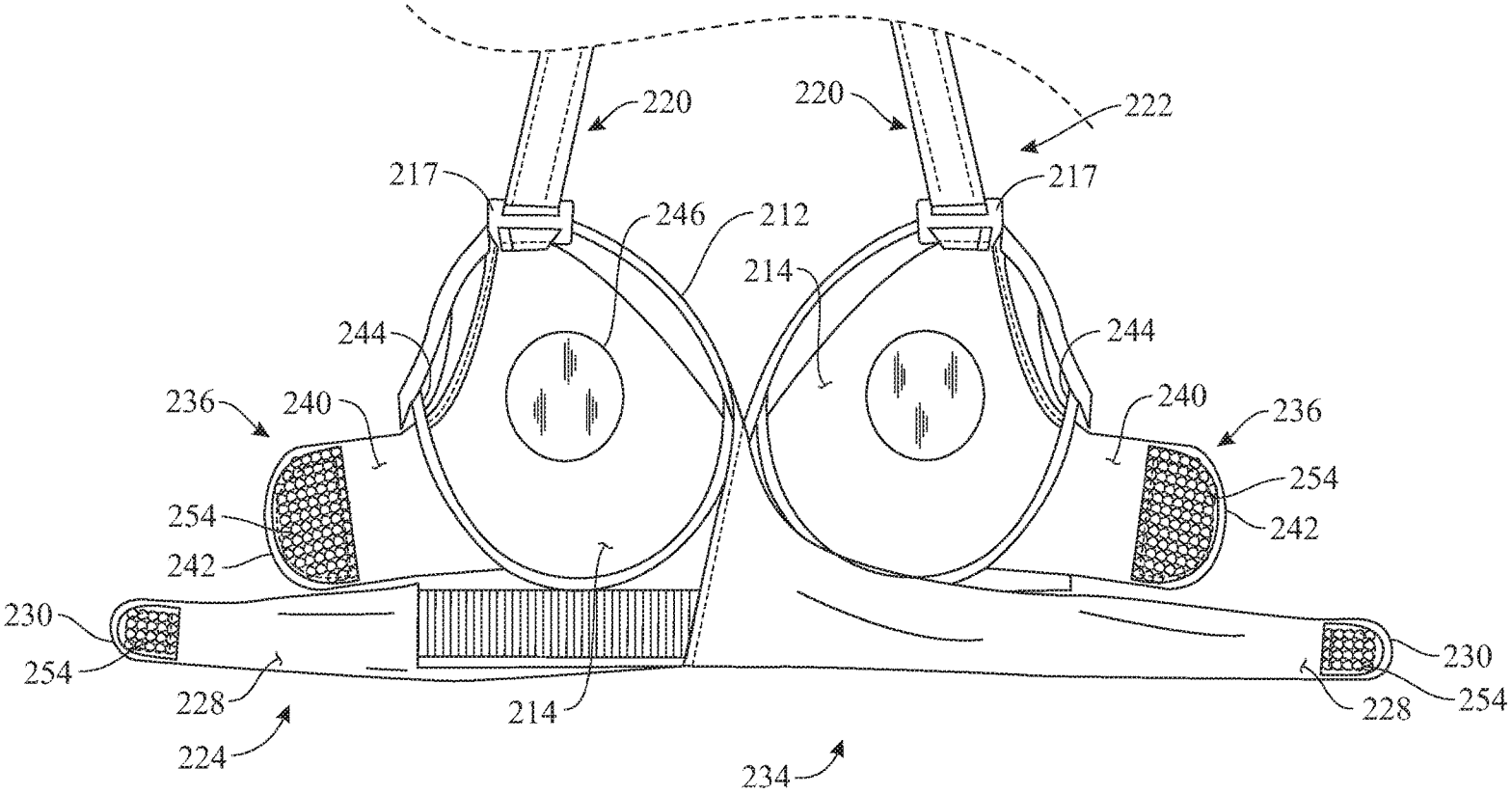

FIG, 9 presents a front isometric view of the bra garment similar to FIG. 4, but incorporating a pair of bands applied on the bar garment in place of the one band shown in FIGS. 1-8;

FIG. 10 presents a front elevation view of an alternative exemplary embodiment of a bra garment of the present invention, showing the bra that can be converted from a nursing bra configuration to a second breast milk engorgement-inhibiting configuration;

FIG. 11 presents a front elevation view of the bra garment originally introduced in FIG. 10, showing the bra garment partially exposing an interior pocket that can be selectively used to breast feed an infant or for the use of a lactation inducing device;

FIG. 12 presents a back elevation view of the bra garment of FIG. 10, showing a plurality of compression bands selectively attached to the back portion of the bra garment;

FIG. 13 presents a back elevation view of the bra garment of FIG. 10;

FIG. 14 presents a back elevation view of another alternative embodiment of the bra garment, wherein the attachment component of the back portion of the bra garment is segmented; and FIG. 15 presents a back elevation view of the interior portion of the bra garment introduced in FIG. 10, showing a pair of interior pockets and compression bands depending from an interior layer on the breast cup that can wrapped around a woman's torso.

Like reference numerals refer to like parts throughout the several views of the drawings.

DETAILED DESCRIPTION OF EXEMPLARY IMPLEMENTATIONS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now primarily to FIGS. 1-3 and 6, there is illustrated a dual-function bra garment, generally designated by reference numeral 100, which has a construction enabling conversion between a "nursing" configuration and a "lactation-suppressing" configuration. The bra garment 100 includes a bra portion 102 that may readily be employed as a nursing bra by selectively releasing upper members 112B, located proximate to upper portions 112A of the respective left and right breast cups 112, from the shoulder straps 114 via releasable connector clips 130, in order to release flaps 128 overlying the breast cups, to selectively expose some or all of a woman's breast to enable the woman to nurse an infant. Upon completion of the use of the bra 102 during nursing, by employment of a plurality of interengageable components, in accordance with various aspects of the dual function convertible bra garment 100, the bra garment may be converted from the nursing configuration to a breast milk engorgement-inhibiting configuration. Various structural elements, components, and the like will be described hereinafter with reference to corresponding drawing FIGS. 1 through 9.

As best shown in FIGS. 1-3 and 6, the bra portion 102 of the convertible bra garment 100 generally includes a base band 104, a front side 106, a rear, or back, side 108, and left and right lateral sides (together referenced herein as reference numeral 110) interconnecting the front and back sides, 106 and 108, respectively. Base band 104 is contiguous with, and depends downwardly from, respective bottom portions of front side 106, back side 108 and lateral sides 110. The front side 106 includes left and right breast cup portions (together denoted by reference numeral 112). The base band 104 may have an endless, or contiguous, annular geometry, intended to completely circumscribe the torso of a wearer. The bra portion 102 will typically include a pair of shoulder straps (together denoted as reference numeral 114) extending between, and attached to, the back side 108 and upper parts 112A of the respective left and right breast cup portions 112. The shoulder straps 114 may include couplers 114. for facilitating adjustment of the shoulder strap lengths, for providing a comfortable fit and support, as is well known in the art. The various structural components of the bra portion 102 may be constructed of panels of conventional flexible fabric materials sewn or otherwise attached to one another. By way of example, but not of limitation, the fabric material of the base band 104 may be substantially elastic, while the other components may be constructed from fabric materials that are substantially inelastic.

Figure 6:
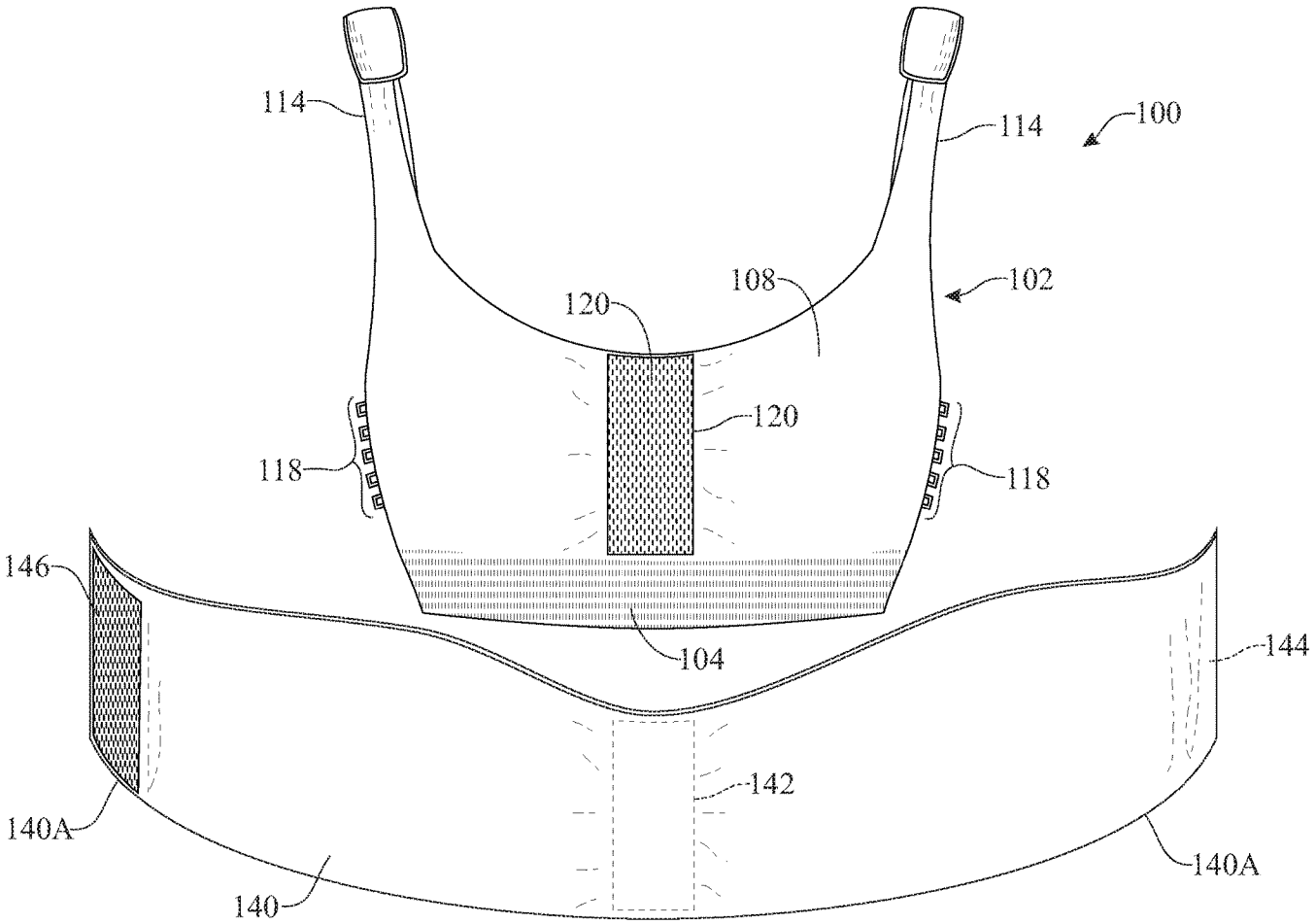
FIG. 6 presents a back elevation view of the bra garment of FIG. 1, now showing yet other attachments on the bra garment in the form of a wrap-around strap shown detached and separated from the bra garment.

Several of the attachments of the bra garment 100, which enable conversion of the bra 102 for use inhibiting breast engorgement, include a pair of loops (shown generally as reference numeral 116), left and right connectors (shown generally as reference numeral 118), and another, or third, connector 120 (shown in FIG. 6). The loops 116 may be in the form of strips of a flexible fabric material being attached at their opposite ends on the front side 106 of the bra 102 adjacent to one another. Together with the front side 106 of the bra 102, the loops 116 each define a band-receiving slot 122, they may be spaced-apart from one another, and they may extend adjacent, and generally parallel to, one another, preferably from between the left and right breast cup portions 112 to proximate the base band 104. For facilitating a wearer during the donning and removing the bra 102, a selectively-closable mechanism 124 (e.g., a conventional zipper, complementary rows of hooks and eyelets, etc.) may be incorporated on the front side 106 of the bra 102 between the pair of spaced-apart loops 116.

Figure 1:
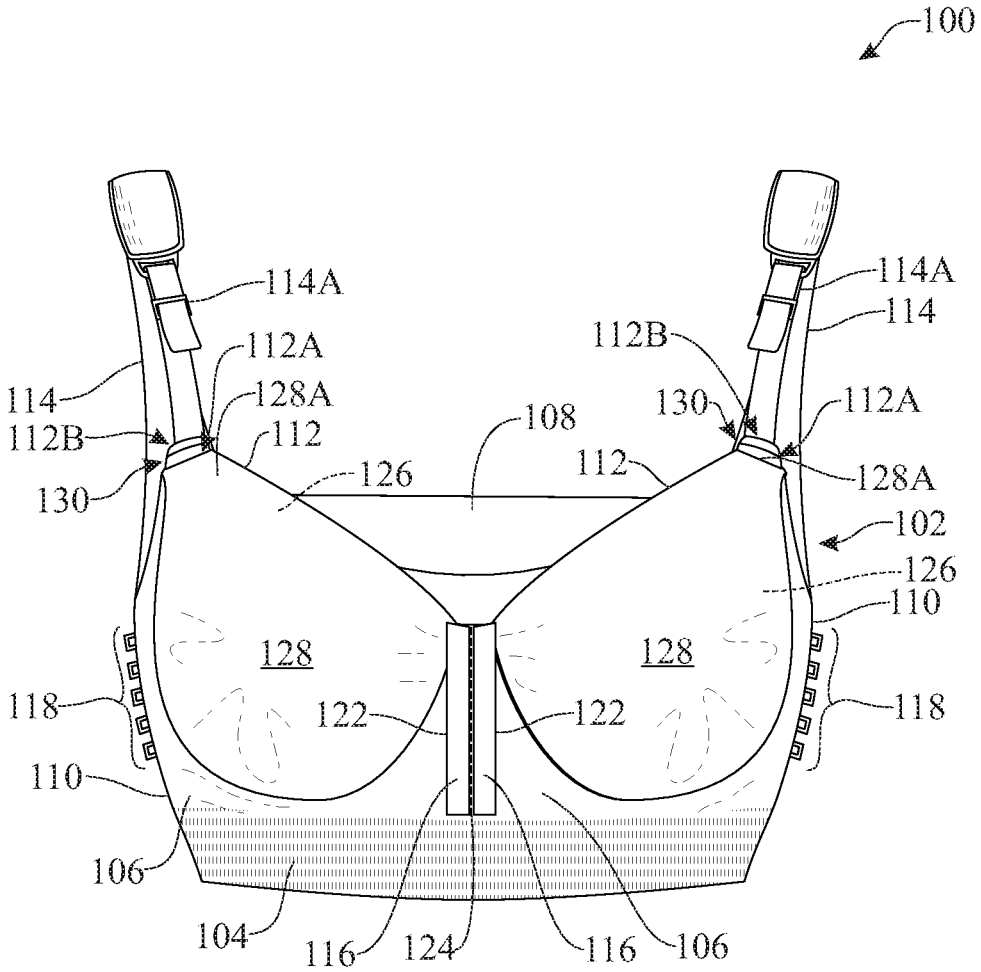
FIG. 1 presents a front elevation view of an exemplary embodiment of a bra garment in accordance with an aspect of the present invention, showing a bra that can be used for nursing and also having attachments thereon for converting the bra for use inhibiting breast engorgement.

The left and right connectors 118 are attached to, and extend vertically on the left and right lateral sides 110 of, the bra 102, as seen in FIG. 1. As shown in FIG. 6, the third connector 120 is attached, preferably centrally, on the back side 106 of the bra 102. By way of example, and not of limitation, the left and right connectors 118 may be in the form of rows of eyelets, patches of selectively attachable and detachable material, conventionally known as "hook-and-loop material," and the like. The third connector 120, by way of example and not of limitation, may be a patch of the same attachable and detachable material.

As best shown in FIGS. 1-3, additional conversion-enabling features of the bra garment 100 may preferably include left and right pockets (together, referred to herein by reference numeral 126) formed in front of, or otherwise overlaying, the respective left and tight breast cup portions 112 on the front side 106 of the bra portion 102. The left and right pockets 126 are created and defined by respective left and right flaps (together referred to herein by reference numeral 128) partially attached to the exterior surface of the front of the corresponding left and right breast cup portions 112. The left and right flaps 128 may have upper end portions 128A that are releasably secured to the respective forward ends of the shoulder straps 114 by clips 130, such that at least the upper end portions 128A of the left and right flaps 128 may be selectively released from the respective shoulder straps 114 to at least partially open the respective pockets 126 in order to receive therein, and remove therefrom, a breast temperature-reducing object 131 for maintaining the cooling object 131 in close proximity to, and preferably against, the respective breast cup portions 112 of the bra body 102. The temperature-reducing object 131 may be any object or material currently in existence or developed in the future, which can be easily cooled and subsequently maintained at a desired cooling temperature, while contained in the pocket. However, it is preferred to use an object, such as a gel-filled or hydrogel-filled breast cooling pad, wherein the cooling material is enveloped or contained within a flexible leak-proof enclosure to prevent seepage of gel or liquid, and wherein the containment material has adequate flexibility to easily adapt or conform to the changing contour of the overlaid breast. As desired, it is contemplated to utilize any convenient cooling object construction or configuration that serves the intended function of the invention. For instance, while the cooling component 131 is shown having a generally circular pad or puck-like geometry, it will be apparent to those skilled in the art that the specific geometry and construction of the cooling component may take on any of a myriad of variations without departing from the intended scope of the invention. By way of example, but not limitation, it is contemplated to incorporate an annular, or donut-shaped, configuration which, when properly inserted and seated within the pocket, avoids cooling contact with the nipple and surrounding areola, while making indirect cooling contact with the surrounding breast skin.

Figure 5:
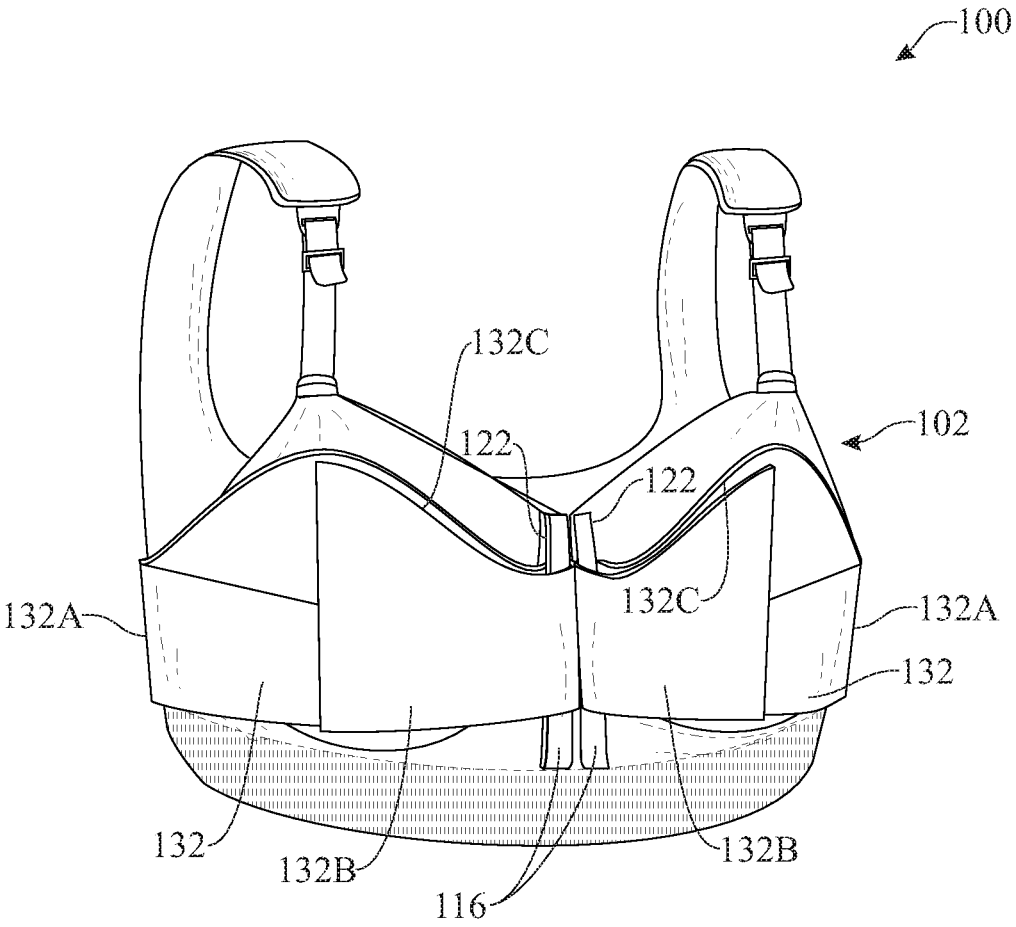
FIG. 5 presents a front isometric view of the bra garment of FIG. 2, now showing still other attachments on the bra garment in the form of a pair of bands.

Referring now primarily to FIGS. 4 and 5, other conversion-enabling and conversion-facilitating components of the convertible bra garment 100 may include at least one (and preferably a pair of) pressure-applying band(s) 132. Each band 132 is selectively attachable to a respective one of the left and right connectors 118 (shown in FIG. 1). More specifically, each band 132 has a first end portion 132A incorporating a connector 134 complementary to the left and right connectors 118 disposed along the respective left and right lateral sides (shown generally as reference numeral 110) of the bra portion 102. The complementary connectors 134, by way of example but not of limitation, may be in the form of a series of hooks (as shown) or, alternatively, patches of mateable portions of a hook-and-loop attachment system. The pressure-applying bands 132, selectively and releasably anchored at the respective left and right lateral sides 110 of the bra portion 102, are then extended forwardly around the front of the respective left and right breast cup portions 112, for selective engagement with the respective loops 116 via insertion of corresponding free ends 132B of the pressure-applying bands 132 through the respective band-receiving slots 122 formed by the loops 116, in order to convert the bra garment 100 for use inhibiting breast engorgement through application of pressure (in conjunction with application of cooling) to the breasts. More specifically, a second, opposite, free distal end portion 132B of each pressure-applying band 132 is inserted through the respective slot 122 of a respective one of the loops 116, and subsequently folded back upon itself, for releasable attachment to another less distal portion 132C of the band 132 adjacent to the loop 116, such that the bands cover, and apply the desired pressure to, the left and tight breast cup portions 112 (and thus, the underlying breasts). As best shown in FIG. 4, the distal free end portion 132B and portion 132C adjacent thereto have complementary connectors 136, 138 thereon, such as mating patches of hook-and-loop material, for selectively releasably attaching the portions 132B, 132C of each band 132 to one another. In this manner, each band 132 can be independently adjusted (i.e., tightened or loosened) to selectively apply the desired degree of pressure. Furthermore, the bands 132 preferably have configurations that substantially conform to the corresponding configurations of the left and tight breast cup portions 112, such that the bands will cover substantially all of the breast cup portions 112 and, accordingly, the milk ducts of the wearer's breasts, in condition for the application of pressure to more effectively cease milk production. Significantly, each pressure-applying band 132 incorporates a band width, along a length of the band that is generally aligned with a corresponding bra cup once the band is tightened, adequate to substantially cover a corresponding bra cup. Furthermore, it will be noted that the bands 132 may be woven through, behind the flaps 128, through the pockets 126, to the loops 116, so as to reduce any bulkiness that might be present when routed in front of the flaps 128.

Figure 7:
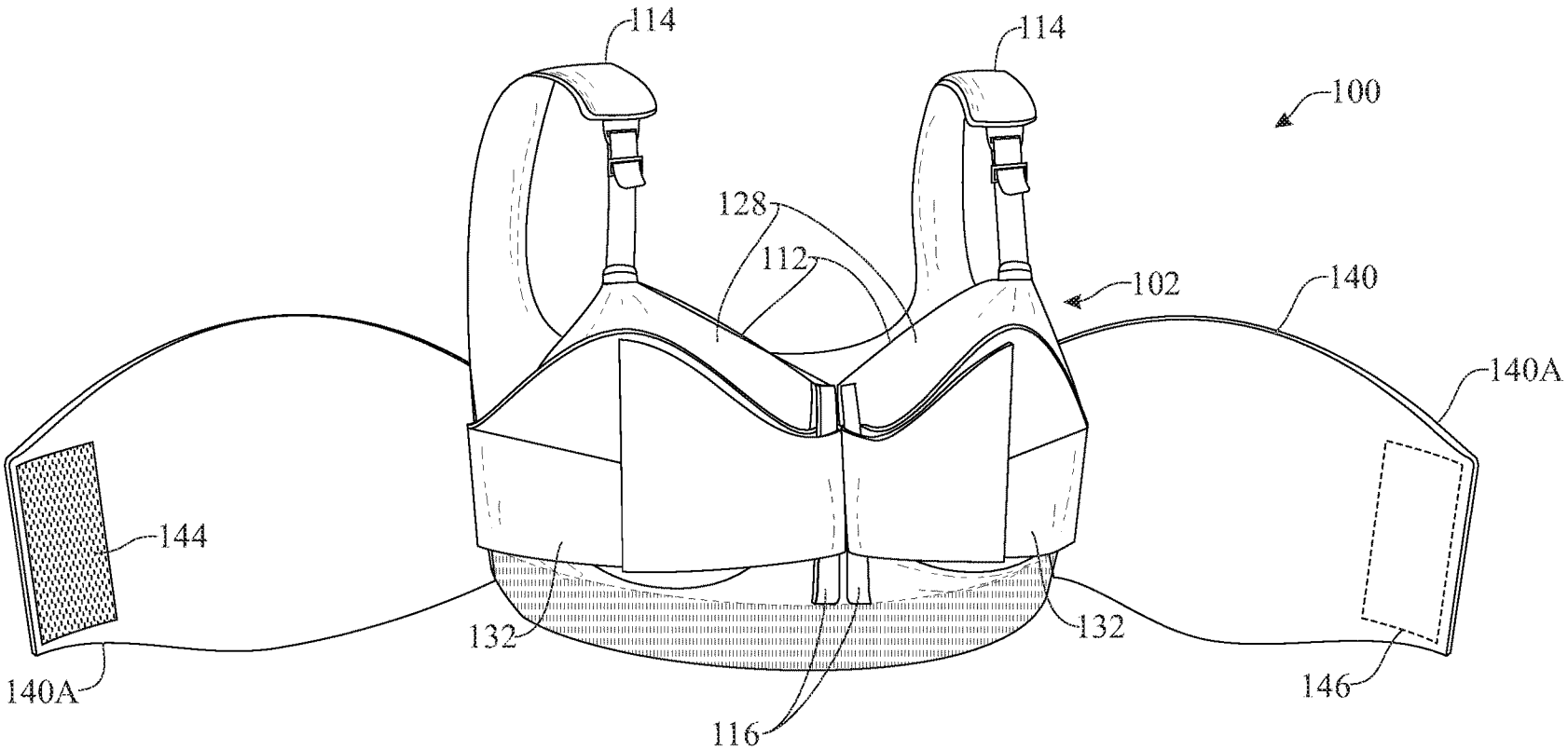
FIG. 7 presents a front isometric view of the bra garment with the attachments of FIGS. 5 and 6 being shown together on the bra garment with the wrap-around strap in an opened position.
Figure 8:
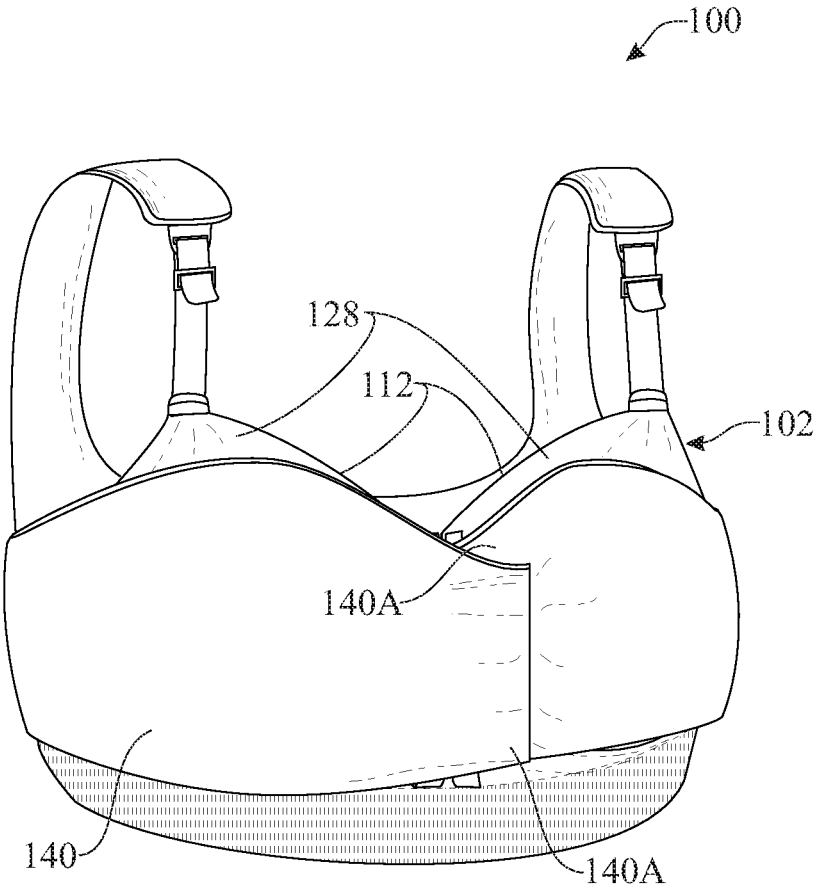
FIG. 8 presents a front isometric view of the bra garment as seen in FIG. 7, but now showing the wrap-around strap in a closed position.

Referring now to FIGS. 6-8, still another conversion-enabling attachment of the bra garment 100 includes a pressure applying wrap-around strap 140. The wrap-around strap 140 has a complementary connector 142 centrally located between opposite free end portions 140A of the wrap-around strap 140. The complementary connector 142 attaches to the third connector 120 on the back side 108 of the bra 102. The strap 140 is of sufficient length to extend in opposite directions away from the mated connectors 120, 142, around the left and right lateral sides 110 of the bra 102, along the bands 132 on the front side 106 of the bra 102, so as to overlap and secure to one another at the free end portions 140A of the strap 140, substantially covering and applying pressure upon the bands 132, and the left and right flaps 128 forming the left and right pockets 126 on the front of the left and right breast cup portions 112 of the bra 102. The overlapped opposite free end portions 1140A of the wrap-around strap 140 have connectors 144, 146 complementary to one another and attached at respective opposite sides thereof. The connectors 144, 146 secure the overlapped free end portions 140A of the strap 140 to one another. The complementary connectors 144, 146, by way of example but not of limitation, may be complementary patches of hook-and-loop material.

Figure 9:
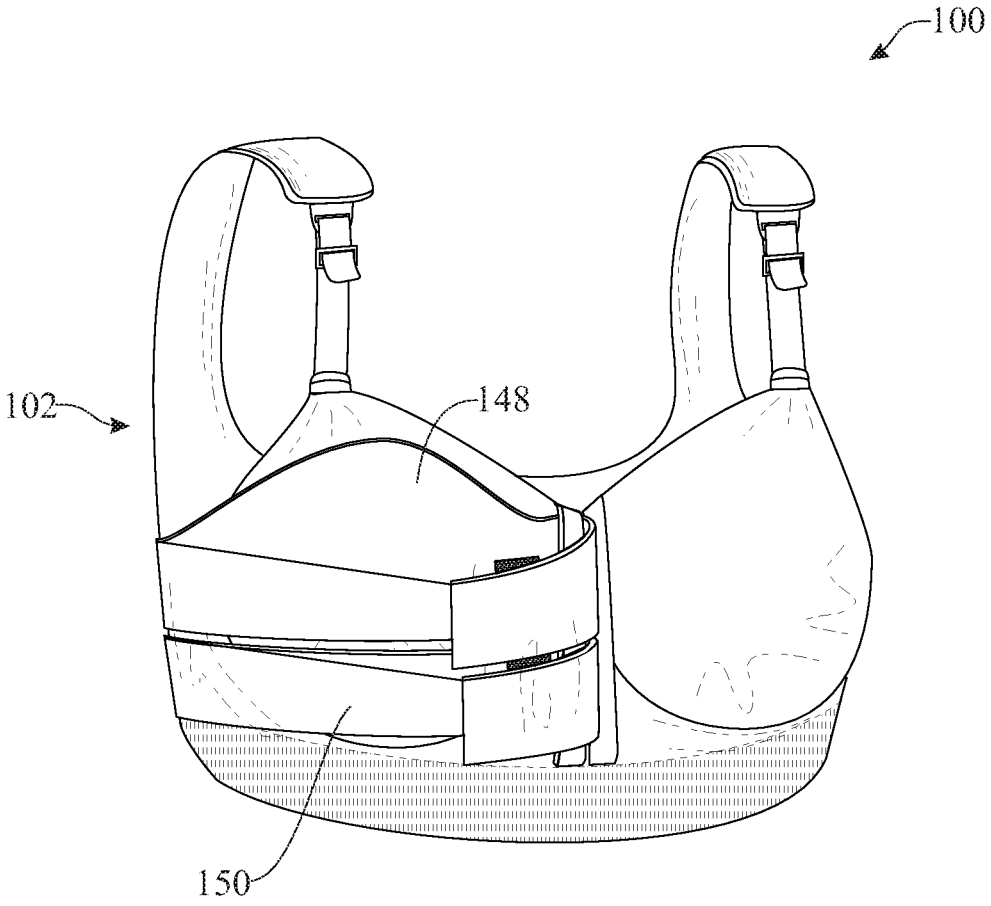

Referring now primarily to FIG. 9, but in conjunction with FIGS. 1-8, in lieu of each band 132 shown in FIGS. 1-8, a pair of bands 148, 150 (FIG. 9) may be employed. Each one of the pair of bands 148, 150 is located directly above or below the respective other band 148, 150, such that each one of the bands 148, 150 is independently releasably secured in a manner substantially covering, and adjustable to selectively apply varying degrees of pressure to, upper and lower sections of a respective one of the left and right breast cup portions of the bra.

Referring now to FIGS. 10-14, there is illustrated an alternative exemplary embodiment of a multi-functional bra garment, generally designated by reference numeral 200, which has a construction that enables the conversion between a "nursing" configuration and a "lactation-suppressing" configuration. The bra garment 200 includes a bra 202 having a front left and right face 204, a lateral left and right side 206 and a back face 208. The front face 204 of the bra 202 includes a breast cup 210 having an exterior layer 212 and an interior layer 214, wherein both the exterior and interior layer 212, 214 of the breast cup 210 may include a first and second releasable clip 216, 217 affixed to the topmost peripheral edge 218 of each respective exterior and interior layer. The bra 202 may also include a pair of elongated adjustable shoulder straps 220 depending from an upper portion 232 of the back face 208 of the bra 202 terminating at a distal end 222 and is selectively fastened to clip 217. Furthermore, the bra garment 202 may also include a first pair of resilient compression straps 224 (or bands) generally provided at a base portion 234 of the bra 202 having an exterior surface 226 and interior surface 228, and having a length extending between a proximal end and terminating at a distal end 230. It is contemplated that the compression straps 224 generally be constructed of an elastic material that provides adequate compression when stretched and worn about and against the chest of a woman. However, other non-elastic materials may be employed that provide a similar function without departing from the intended scope of the invention. Referring particularly to FIGS. 12 and 15, the bra garment 202 preferably includes a second pair of resilient compression straps 236 depending from the breast cups 210 interior layer 214 that protrude outwardly from a slit 244. provided on the right and left lateral side 206 of the bra garment 202. The second pair of compression bands 236 generally includes an exterior surface 238 and interior surface 240 having a length extending from a proximal end and terminating at a distal end 242.

Referring now primarily to FIGS. 10 and 11, the bra garment 200 may readily be employed as a nursing bra by selectively releasing the first clip 216 affixed to the bra cups 210 exterior layer 212 from the bra garment's 202 second clip 217. The release of the first clip 216 allows for the exposure of the interior layer 214 of the bra garment 202 which may include a centrally located circular opening 246 that functions to partially expose a woman's breast, particularly the nipple area, so as to enable a woman to nurse an infant or alternatively apply a lactation inducing device, such as a breast pump, as needed without overexposing her breast to her surroundings.

As is best shown on FIG. 11, the bra garment 202 may preferably include a pocket 248 formed in front of, or otherwise overlaying, the interior layer 214 of the breast cup 210. The pocket is created and defined by a cavity therebetween the exterior and interior layer 212, 214 of the breast cup which are partially attached along hem line 250. The breast pocket 248 may be exposed by selectively releasing clip 216 affixed to the bra cups exterior layer 212 from clip 217. Although the exposure of the breast pocket 248 is preferably done for the act of nursing a baby (approximately between the age of birth to 4 years old) or for the application of a lactation inducing device (e.g. breast pump), the pocket 248 may also be contemplated to be used for the application and removal of a breast temperature-reducing object (not shown), and particularly for the maintaining the cooling object in close proximity to, and in some instances preferably against, the respective nipple and areola of a woman's breast. Alternatively, the forming of the interior breast pocket 248 may also be employed for the application and removal of a pad (not shown) for the absorption of accidental discharge of fluid from a woman's breast, which is a common occurrence during a nursing phase. By way of example only, in the event a woman begins to lactate without an infant or collection device present (e.g. a reservoir), a pad may be placed inside of the breast pocket 248 in between the breast cup's exterior and interior layer 212, 214. The pad is preferably placed in close proximity to the opening 246 on the breast cups interior layer 214, which partially exposes the woman's breast and nipple, so that the pad can readily absorb any accidental discharge. The pad is then periodically swapped for a new one as needed depending on the saturation level of the pad and comfort level of the woman.

Referring now primarily to FIGS. 10, 12-14, illustrates the conversion-facilitating components that enable the conversion of the bra garment 200 from a "nursing" configuration to a "lactation-suppressant" configuration. Generally, this alternative configuration is employed through the reapplication and cinching of the compression straps 224 provided at the base portion 234 of the bra 202. Although not currently shown, the bra garment 200 provides a central gap that separates the left and right breast cup 210 when the bra is in an open configuration (i.e. the left and right breast cups are not attached to one another).The process of donning the bra garment 202 generally includes a woman inserting her arms through each respective loop formed by the should straps 220 that are affixed to the back portion 232 of the back face 208 of the bra 202 and fastened on the opposite side to the breast cup releasable clip 217, Once each shoulder strap 220 is resting on the woman's shoulders the shoulder straps 220 are adjusted so the breast cups 210 are resting proximate to her breasts fatty tissue, which is the tissue that is overlying the chests pectoral muscle. Otherwise, if the brassiere 202 rests too high on the woman's chest, for instance in close proximity to the collarbone, it may not be possible to provide sufficient pressure to the woman's breast to effectively prevent engorgement.

Once the shoulder straps are adjusted to the appropriate length, the left and right pair of compression straps 224 are wrapped across the front portion of the woman's body by overlapping the left and right strap across one another (e.g. in a crisscross manner) just below the breast cup 210. A visual representation for illustration purposes of how the straps 224 look in a crossed manner is more clearly seen on FIG. 10. To help facilitate wrapping the compression straps 224 across the woman's upper torso and back, the straps 224 may include a tab member 252 affixed to the exterior surface 226 of the strap near its distal end 230. Opposite tab member 252, on the interior surface 228 of the strap 224 a complementary connector 254, such as a mating patch, of hook-and-loop material is provided. By way of example only, the tab member 252 provided to the exterior surface of the strap 224 may allow a woman to utilize a finger, such as a thumb, to more sturdily grip strap member 224 as she stretches the strap across her body and wrap the strap 224 across her torso to connect the complementary connector 254 to connector 256 on the back face 208 of the bra garment, both of which may be made out of a hook-and-loop material (e.g. OMNI-TAPE brand fasteners manufactured by industrial Webbing Corporation of Boynton Beach, Fla.) or any alternative material as is described herein above. In this manner, each strap 224 can be independently adjusted (i.e. tightened or loosened) to selectively apply the desired degree of pressure to the left or right breast as needed to prevent engorgement of the breast. In an alternate embodiment of the present disclosure, without departing from the intended scope, it is contemplated that the connector 256 particularly shown on FIG. 13 may be provided in segments (as shown on FIG. 14) to increase torsional flexibility during usage of the bra garment 202.

Referring now primarily to FIGS. 12 and 15, other conversion-enabling and conversion-facilitating components of the convertible bra garment 200 preferably include at least a second pair of pressure-applying compression straps 236, Each strap may depend from a respective one of the left or right interior layers 214 of the bra garments 202 breast cup 210. Each of the second pair of straps 236 protrude outwardly through a slit 244 provided on the left and right lateral sides 206 of the bra garment 202. More specifically, the second pair of compression strap 236 may include an interior surface 240 and an exterior surface 238 having a length extending from a proximal end and terminating at a distal end 242. By way of example, but not of limitation, the second pair of compression straps 236 may include a tab member 252 affixed to exterior surface 238 proximate distal end 242. Opposite tab member 252, on the straps interior surface 240 a complementary connector 254 is provided. Tab members 252 are provided to the exterior surface of the straps 236 to enable a woman to utilize a finger or other digit, such as a thumb, to better grip the strap 236 as it is stretched across the respective left or right lateral portions of the torso to releasably connect the complementary connector 254 affixed to the straps distal end 242 to connector 256 on the back face 208 of the bra garment 202. As the straps 236 are pulled outwardly the interior layer 214 of the breast cup 210, from which the straps 236 depend, stretch simultaneously with compression straps 236 to firmly apply a compressive force against the woman's fatty breast tissue. Each strap 236 may be independently adjusted to selectively apply the desired degree of pressure to each breast as needed to inhibit breast engorgement.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A multi-configurational bra garment, the bra garment comprising:

a bra body portion including a left front face and a right front face, a central gap defined by separation of said left and right front face, a rear face and a pair of right and left lateral sides adjoining said left and right front and rear faces such that said left lateral side is attached to said left front face and the left side of said rear face and said right lateral side is attached to said right front face and the right side of said rear face, and a pair of left and right breast cup portions integrated into the respective one of said left and right front faces of said bra body portion, wherein said pair of left and right breast cup portions include a first layer disposed over a second layer, said first layer having a first mechanical coupling mechanism attached to an upper edge, and said second layer having a second mechanical coupling mechanism attached to an upper edge, each of said first and second mechanical coupling mechanisms being configurable for releasable attachment;

a pair of shoulder straps, each shoulder strap having a length extending, and attached at opposite shoulder strap length ends to, an upper portion of said back face of said bra body portion and to the respective one of each of said left and right breast cup portions second layer mechanical coupling mechanism;

a first pair of pressure-applying straps, said first pair of straps include, a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps are configured for releasable attachment when said bra garment is donned by disposing said first strap over said second strap and attaching said coupling mechanism of each respective one of said straps to a connector mechanism integrated therewith on said back face of said bra body portion; and a second pair of pressure-applying straps, said second pair of straps include, a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and right lateral sides of said bra body portion, proximate said distal end of each respective one of said second pair of pressure-applying straps being integrated therewith a coupling mechanism on said interior surface, wherein said first and second strap of said second pair of pressure-applying straps are configured for releasable attachment when said bra garment is donned by extending said first and second strap rearwardly and attaching said coupling mechanism of each respective one of said straps to said connector mechanism integrated therewith on said back face of said bra body portion.

2. A multi-configurational bra garment as recited in claim 1, wherein said corresponding first and second layer of said pair of left and right breast cup portions are partially affixed to one another defining and forming at least one interior pocket therebetween said first and second layer.

3. A multi-configurational bra garment as recited in claim 2, wherein said second layer of said corresponding pair of left and right breast cup portions provide a centralized circular opening for partially exposing a wearer's breast.

4. A multi-configurational bra garment as recited in claim 3, wherein said at least one interior pocket defined and formed by said first and second layer of said corresponding first and second breast cup portions is shaped and otherwise configured for snugly receiving a soaking pad to be retained therein and in close proximity to said circular opening provided on said second layer of said breast cup portions for absorbing fluids released from said wearer's partially exposed breast.

5. A multi-configurational bra garment as recited in claim 3, wherein said centralized circular opening provided in said at least one interior pocket defined and formed by said first and second layer of said corresponding first and second breast cup portion is shaped and otherwise configured for receiving a lactation-inducing device to be disposed over said wearer's partially exposed breast.

6. A multi-configurational bra garment as recited in claim 3, wherein said centralized circular opening provided in said at least one interior pocket defined and formed by said first and second layer of said corresponding first and second breast cup portion is shaped and otherwise configured for enabling said wearer to nurse a baby.

7. A multi-configurational bra garment as recited in claim 1, wherein said first and second strap of said first pair of pressure-applying straps include a gripping mechanism affixed approximately to said distal end of each respective one of said first and second straps exterior surface, enabling a wearer to grip and apply a desirable degree of pressure against a wearer's lower breast portion when said first and second strap of said first pair of pressure-applying straps are releasably attached to said connector mechanism of said back face of said bra body portion when said bra garment is donned.

8. A multi-configurational bra garment as recited in claim 1, wherein said first and second strap of said second pair of pressure-applying straps include a gripping mechanism affixed approximately to said distal end of each respective one of said first and second straps exterior surface, enabling a wearer to grip and apply a desirable degree of pressure against a wearer's upper breast portion when said first and second strap of said second pair of pressure-applying straps are releasbly attached to said connector mechanism of said back face of said bra garment when said bra garment is donned.

9. A multi-configurational bra garment as recited in claim 1, wherein said connector mechanism of said back face comprises of a plurality of longitudinal segments spaced-apart extending therebetween said left and right lateral sides on said back face.

10. A multi-configurational bra garment, the bra garment comprising:

a bra body portion including a left front face and a right front face, a central gap defined by separation of said left and right front face, a rear face and a pair of right and left lateral sides adjoining said left and right front and rear faces such that said left lateral side is attached to said left front face and the left side of said rear face and said right lateral side is attached to said right front face and the right side of said rear face, and a pair of left and right breast cup portions integrated into the respective one of said left and right front faces of said bra body portion, wherein said pair of left and right breast cup portions include a first layer disposed over a second layer having a centralized circular opening enabling partial exposure of a wearer's breast, said first and second layer partially affixed to one another defining and forming at least one interior pocket therebetween said first and second layer, said first layer having a first mechanical coupling mechanism attached to an upper edge, and said second layer having a second mechanical coupling mechanism attached to an upper edge, and each of said first and second mechanical coupling mechanisms being configurable for releasable attachment;

a pair of shoulder straps, each shoulder strap having a length extending, and attached at opposite shoulder strap length ends to, an upper portion of said back face of said bra body portion and to the respective one of each of said left and right breast cup portions second layer mechanical coupling mechanism;

a first pair of pressure-applying straps, said first pair of straps include, a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps are configured for releasable attachment when said bra garment is donned by disposing said first strap over said second strap and attaching said coupling mechanism of each respective one of said straps to a connector mechanism integrated therewith on said back face of said bra body portion; and a second pair of pressure-applying straps, said second pair of straps include, a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and right lateral sides of said bra body portion, proximate said distal end of each respective one of said second pair of pressure-applying straps being integrated therewith a coupling mechanism on said interior surface, wherein said first and second strap of said second pair of pressure-applying straps are configured for releasable attachment when said bra garment is donned by extending said first and second strap rearwardly and attaching said coupling mechanism of each respective one of said straps to said connector mechanism integrated therewith on said back face of said bra body portion.

11. A multi-configurational bra garment as recited in claim 10, wherein said at least one interior pocket defined and formed by said first and second layer of said corresponding first and second breast cup portions is shaped and otherwise configured for snugly receiving a soaking pad to be retained therein and in close proximity to said circular opening provided on said second layer of said breast cup portions for absorbing fluids released from said wearer's partially exposed breast.

12. A multi-configurational bra garment as recited in claim 10, wherein said centralized circular opening provided in said at least one interior pocket defined and formed by said first and second layer of said corresponding first and second breast cup portion is shaped and otherwise configured for receiving a lactation-inducing device to be disposed over said wearer's partially exposed breast.

13. A multi-configurational bra garment as recited in claim 10, wherein said centralized circular opening provided in said at least one interior pocket defined and formed by said first and second layer of said corresponding first and second breast cup portion is shaped and otherwise configured for enabling said wearer to nurse a baby.

14. A multi-configurational bra garment as recited in claim 10, wherein said first and second strap of said first pair of pressure-applying straps include a gripping mechanism affixed approximately to said distal end of each respective one of said first and second straps exterior surface, enabling a wearer to grip and apply a desirable degree of pressure against a wearer's lower breast portion when said first and second strap of said first pair of pressure-applying straps are releasably attached to said connector mechanism of said back face of said bra body portion when said bra garment is donned.

15. A multi-configurational bra garment as recited in claim 10, wherein said first and second strap of said second pair of pressure-applying straps include a gripping mechanism affixed approximately to said distal end of each respective one of said first and second straps exterior surface, enabling a wearer to grip and apply a desirable degree of pressure against a wearer's upper breast portion when said first and second strap of said second pair of pressure-applying straps are releasbly attached to said connector mechanism of said back face of said bra garment when said bra garment is donned.

16. A multi-configurational bra garment as recited in claim 10, wherein said connector mechanism of said back face comprises of a plurality of longitudinal segments spaced-apart extending therebetween said left and right lateral sides on said back face.

17. A multi-configurational bra garment, the bra garment comprising:

a bra body portion including a left front face and a right front face, a central gap defined by separation of said left and right front face, a rear face and a pair of right and left lateral sides adjoining said left and right front and rear faces such that said left lateral side is attached to said left front face and the left side of said rear face and said right lateral side is attached to said right front face and the right side of said rear face, and a pair of left and right breast cup portions integrated into the respective one of said left and right front faces of said bra body portion, wherein said pair of left and right breast cup portions include a first layer disposed over a second layer having a centralized circular opening enabling partial exposure of a wearer's breast, said first and second layer partially affixed to one another defining and forming at least one interior pocket therebetween said first and second layer, said first layer having a first mechanical coupling mechanism attached to an upper edge, and said second layer having a second mechanical coupling mechanism attached to an upper edge, and each of said first and second mechanical coupling mechanisms being configurable for releasable attachment;

a pair of shoulder straps, each shoulder strap having a length extending, and attached at opposite shoulder strap length ends to, an upper portion of said back face of said bra body portion and to the respective one of each of said left and right breast cup portions second layer mechanical coupling mechanism;

a first pair of pressure-applying straps, including:

a first strap and a second strap provided at a base portion of said left and right front face, said first pair of pressure-applying straps having an exterior surface, an interior surface, and having a length extending between a proximal end and a distal end, proximate said distal end of each respective one of said first pair of pressure-applying straps being integrated therewith a coupling mechanism on said interior surface, wherein said first and second strap of said first pair of pressure-applying straps include a gripping mechanism affixed approximately to said distal end of each respective one of said first and second straps exterior surface, enabling said wearer to grip said gripping mechanism and apply a desirable degree of pressure against a wearer's lower breast portion when said bra garment is donned by disposing said first strap over said second strap and releasably-attaching said coupling mechanism of each respective one of said straps to a connector mechanism integrated therewith on said back face of said bra body portion; and a second pair of pressure-applying straps, including:

a first strap and a second strap depending from said second layer of said breast cup, said second pair of pressure-applying straps having an exterior surface, an interior surface, and having a length extending between a proximal end and a distal end, wherein said first and second strap of said second pair of pressure-applying straps respectively extend outwardly through a corresponding slit on said left and right lateral sides of said bra body portion, proximate said distal end of each respective one of said second pair of pressure-applying straps being integrated therewith a coupling mechanism on said interior surface, said first and second strap of said second pair of pressure-applying straps include a gripping mechanism affixed approximately to said distal end of each respective one of said first and second straps exterior surface, enabling said wearer to grip said gripping mechanism and apply a desirable degree of pressure against a wearer's upper breast portion when said bra garment is donned by extending said first and second strap rearwardly and attaching said coupling mechanism of each respective one of said straps to said connector mechanism integrated therewith on said back face of said bra body portion.

18. A multi-configurational bra garment as recited in claim 17, wherein said at least one interior pocket defined and formed by said first and second layer of said corresponding first and second breast cup portions is shaped and otherwise configured for snugly receiving a soaking pad to be retained therein and in close proximity to said circular opening provided on said second layer of said breast cup portions for absorbing fluids released from said wearer's partially exposed breast.

19. A multi-configurational bra garment as recited in claim 17, wherein said centralized circular opening provided in said at least one interior pocket defined and formed by said first and second layer of said corresponding first and second breast cup portion is shaped and otherwise configured for receiving a lactation-inducing device to be disposed over said wearer's partially exposed breast.

20. A multi-configurational bra garment as recited in claim 17, wherein said centralized circular opening provided in said at least one interior pocket defined and formed by said first and second layer of said corresponding first and second breast cup portion is shaped and otherwise configured for enabling said wearer to nurse a baby.

* * * * *